US007804470B2

(12) United States Patent
Poon

(10) Patent No.: US 7,804,470 B2
(45) Date of Patent: Sep. 28, 2010

(54) TEMPERATURE ADAPTIVE OVERDRIVE METHOD, SYSTEM AND APPARATUS

(75) Inventor: Eunice Poon, Scarborough (CA)

(73) Assignee: Seiko Epson Corporation, Tokyo (JP)

( * ) Notice: Subject to any disclaimer, the term of this patent is extended or adjusted under 35 U.S.C. 154(b) by 832 days.

(21) Appl. No.: 11/690,632

(22) Filed: Mar. 23, 2007

(65) Prior Publication Data

US 2008/0231624 A1 Sep. 25, 2008

(51) Int. Cl.
*G09G 3/36* (2006.01)

(52) U.S. Cl. ..... 345/87; 345/89; 345/690

(58) Field of Classification Search ..... 345/87, 345/88, 89, 90, 101, 106, 690
See application file for complete search history.

(56) References Cited

U.S. PATENT DOCUMENTS

| | | | | |
|---|---|---|---|---|
| 6,414,664 | B1 * | 7/2002 | Conover et al. | 345/89 |
| 7,148,869 | B2 * | 12/2006 | Chen et al. | 345/89 |
| 7,642,999 | B2 * | 1/2010 | Oura | 345/98 |
| 2001/0043205 | A1 | 11/2001 | Huang et al. | |
| 2002/0149574 | A1 | 10/2002 | Johnson et al. | |
| 2004/0246224 | A1 | 12/2004 | Tsai et al. | |
| 2005/0068343 | A1 * | 3/2005 | Pan et al. | 345/690 |
| 2005/0140634 | A1 | 6/2005 | Takatori | |
| 2005/0146495 | A1 | 7/2005 | MacKinnon et al. | |
| 2005/0179854 | A1 * | 8/2005 | Sekine et al. | 349/161 |
| 2005/0195140 | A1 | 9/2005 | Halfant | |
| 2005/0219180 | A1 | 10/2005 | Kubo et al. | |
| 2005/0225525 | A1 | 10/2005 | Wu et al. | |
| 2006/0050038 | A1 | 3/2006 | Cheon et al. | |
| 2006/0103682 | A1 * | 5/2006 | Kunimori et al. | 345/690 |
| 2006/0109221 | A1 * | 5/2006 | Park | 345/88 |
| 2006/0158415 | A1 | 7/2006 | Izumi | |
| 2006/0219700 | A1 | 10/2006 | Chen et al. | |
| 2007/0075951 | A1 * | 4/2007 | Lin et al. | 345/89 |
| 2007/0126678 | A1 * | 6/2007 | Shih et al. | 345/89 |

* cited by examiner

*Primary Examiner*—Amare Mengistu
*Assistant Examiner*—Koosha Sharifi
(74) *Attorney, Agent, or Firm*—Mark P. Watson

(57) ABSTRACT

A method and system for calculating an overdrive parameter for a liquid crystal within an LCD device to compensate for temperature variations. An example system includes a temperature sensor for measuring an ambient temperature near a liquid crystal and a memory for storing a lookup table containing a plurality of overdrive parameters. Each overdrive parameter corresponds to a graylevel transition between a previous frame and a current frame, and represents a level at which a liquid crystal is driven in order to achieve a desired response time for the graylevel transition at a reference temperature. A processor extracts the appropriate overdrive parameter from the lookup and calculates an adapted overdrive parameter that adjusts for the difference between the measured ambient temperature and the reference temperature.

17 Claims, 7 Drawing Sheets

202

204

206

| Start level | Target level | | | | | | | | |
|---|---|---|---|---|---|---|---|---|---|
| | 0 | 31 | 63 | 95 | 127 | 156 | 191 | 223 | 255 |
| 0 | | +4 | +5 | +6 | +6 | +8 | +8 | +9 | +9 |
| 31 | -2 | | 0 | +2 | +3 | +4 | +5 | +7 | +8 |
| 63 | -5 | -4 | | -1 | +2 | +3 | +5 | +7 | +8 |
| 95 | -1 | -1 | 0 | | +2 | +3 | +4 | +5 | +5 |
| 127 | +2 | +2 | +2 | +2 | | +2 | +3 | +4 | +3 |
| 156 | -1 | 0 | 0 | 0 | 1 | | +2 | +2 | +2 |
| 191 | -1 | -1 | -1 | -1 | -1 | -1 | | 0 | 0 |
| 223 | -2 | -3 | -2 | -2 | -2 | -2 | -2 | | -1 |
| 255 | -6 | -6 | -7 | -8 | -9 | -9 | -10 | -10 | |

FIGURE 2A

202

204

208

| Start level | Target level | | | | | | | | |
|---|---|---|---|---|---|---|---|---|---|
| | 0 | 31 | 63 | 95 | 127 | 156 | 191 | 223 | 255 |
| 0 | | +3 | +3 | +4 | +4 | +5 | +4 | +5 | +5 |
| 31 | -2 | | -1 | -1 | 0 | 0 | 0 | +1 | +2 |
| 63 | -3 | -2 | | -1 | +1 | +2 | +2 | +3 | +4 |
| 95 | +1 | +1 | +1 | | +2 | +2 | +2 | +2 | +2 |
| 127 | +2 | +2 | +2 | +2 | | +2 | +2 | +2 | +2 |
| 156 | -1 | 0 | 0 | 0 | +1 | | +2 | +2 | +2 |
| 191 | 0 | 0 | 0 | 0 | 0 | 0 | | +2 | +2 |
| 223 | -1 | -2 | -1 | -1 | -1 | -2 | -2 | | -1 |
| 255 | -3 | -4 | -4 | -6 | -6 | -6 | -7 | -7 | |

FIGURE 2B

202

204

210

| Start level | Target level | | | | | | | | |
|---|---|---|---|---|---|---|---|---|---|
| | 0 | 31 | 63 | 95 | 127 | 156 | 191 | 223 | 255 |
| 0 | | -5 | -5 | -6 | -6 | -8 | -8 | -9 | -9 |
| 31 | 2 | | -1 | -2 | -3 | -5 | -5 | -7 | -8 |
| 63 | 4 | 3 | | 0 | -2 | -3 | -5 | -7 | -8 |
| 95 | 0 | 0 | -1 | | -3 | -3 | -5 | -6 | -6 |
| 127 | 0 | -3 | -2 | -3 | | -3 | -3 | -4 | -4 |
| 156 | 0 | 0 | 0 | -1 | -1 | | -2 | -2 | -3 |
| 191 | 0 | 0 | 0 | 0 | 0 | 0 | | 0 | 0 |
| 223 | 2 | 2 | 1 | 2 | 2 | 1 | 1 | | 0 |
| 255 | 6 | 6 | 7 | 7 | 8 | 9 | 10 | 10 | |

FIGURE 2C

202

204

212

| Start level | Target level | | | | | | | | |
|---|---|---|---|---|---|---|---|---|---|
| | 0 | 31 | 63 | 95 | 127 | 156 | 191 | 223 | 255 |
| 0 | | -4 | -3 | -4 | -4 | -5 | -5 | -5 | -6 |
| 31 | 2 | | 0 | 0 | 0 | -1 | -1 | -1 | -2 |
| 63 | 2 | 1 | | 0 | -1 | -2 | -2 | -3 | -5 |
| 95 | 0 | -1 | -1 | | -3 | -2 | -3 | -3 | -3 |
| 127 | 0 | -3 | -2 | -3 | | -3 | -2 | -2 | -3 |
| 156 | 0 | 0 | 0 | -1 | -1 | | -2 | -2 | -3 |
| 191 | 0 | -1 | -1 | -1 | -1 | -1 | | -2 | -2 |
| 223 | 1 | 1 | 0 | 1 | 1 | 1 | 1 | | 0 |
| 255 | 3 | 4 | 4 | 5 | 5 | 6 | 7 | 7 | |

FIGURE 2D

TEMPERATURE ADAPTIVE OVERDRIVE METHOD, SYSTEM AND APPARATUS

BACKGROUND

1. The Field of the Invention

The present invention relates generally to a method and apparatus for driving a display device. More specifically, the present invention relates to methods and systems for improving a response speed of a liquid crystal display.

2. The Relevant Technology

Liquid crystal displays (LCD's) are widely used in a number of products, such as flat panel televisions, computer screens, mobile telephone displays, and the like. One drawback common to liquid crystals is their inability to quickly and consistently respond to rapidly changing images. The response time of liquid crystals can be slow, and may vary depending on the starting and target graylevels produced by the liquid crystals. This slow response can result in poor video quality.

To compensate for slow liquid crystal cell response, one technique applies an amplification factor, or "overdrive" voltage, to pixel changes during a frame transition. This adjusts the time required to reach the target frame, thereby improving the motion picture quality of LCD panels and reducing motion blurriness.

With this technique, a lookup table is created containing overdrive levels corresponding to various different starting graylevels and target graylevels. An overdrive parameter is retrieved from the lookup table that corresponds to the starting graylevel of the preceding frame and the target graylevel of the current frame. This retrieved overdrive parameter is then applied to the liquid crystal with the intent of causing the liquid crystal to produce the appropriate response time.

Selecting an appropriate overdrive parameter can be difficult because the response time of a liquid crystal varies depending on the ambient temperature. Therefore, the overdrive parameters stored in a single lookup table are only valid at a single ambient temperature. Temperature variations are particularly problematic for mobile display panels, which are often exposed to relatively wide temperature variations.

One solution to this problem is to store overdrive data calibrated at different temperature settings in multiple lookup tables. Each lookup table is calibrated for a different temperature setting in order to achieve accurate and reliable liquid crystal response times in different temperature environments. However, this solution inevitably increases the memory bandwidth required by the overdrive process, thereby driving up the memory cost of the overdrive unit. This approach may not be feasible for certain applications that operate on systems with limited resources.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

One example embodiment of the present invention is directed to a method of compensating for temperature variations when driving an LCD device. When performing the illustrated method, a single reference lookup table can be used, which contains a plurality of "overdrive" parameters calculated at a single reference temperature. The overdrive parameters represent a level at which a liquid crystal should be driven in order to achieve a desired response time for a variety of different graylevel transitions between a first frame (i.e., a starting graylevel) and a second frame (i.e., a target graylevel).

In an illustrated embodiment, an ambient temperature is measured near a liquid crystal. The overdrive parameter that corresponds to the starting graylevel of the liquid crystal and the target graylevel for the liquid crystal is then extracted from the lookup table. A temperature adaptive algorithm is applied to the extracted overdrive parameter to determine an "adapted overdrive parameter." This adapted overdrive parameter adjusts for the difference between the measured ambient temperature and the reference temperature. The adapted overdrive parameter is then used to drive the LCD device for achieving the desired response. One advantage of this approach is that only a single look-up table is required. The extra cost and inefficiency necessitated by multiple lookup tables calibrated at different reference temperatures is eliminated.

Variations on this general approach are also illustrated. For example, in another embodiment the ambient temperature near a liquid crystal is measured, and an overdrive parameter is extracted from a lookup table containing a plurality of overdrive parameters. While a single lookup table can be used, as described above, in another approach the lookup table may be selected from two or more lookup tables that are each calibrated at a different reference temperature. The lookup table that is selected can be the one, for example, with the reference temperature that is closest to the measured ambient temperature. A temperature adaptive algorithm can be applied to the overdrive parameter extracted from the lookup table for calculating an adapted overdrive parameter.

The temperature adaptive algorithm can be a function of several factors, including for example the measured ambient temperature, the reference temperature, a start graylevel and a target graylevel. In this way, the adaptive algorithm accounts for differences that may exist between the measured ambient temperature and the reference temperature of the lookup table used to provide the overdrive parameter.

Illustrated embodiments of the present invention are also directed to a system that is configured to compensate for temperature variations within a LCD device. In an example system, a temperature sensor for measuring an ambient temperature is provided near a liquid crystal. A memory is employed for storing a lookup table containing a plurality of overdrive parameters. Each overdrive parameter within the lookup table corresponds to a graylevel transition between a previous frame and a current frame, and represents a level at which a liquid crystal should be driven in order to achieve a desired response time for the graylevel transition at a reference temperature. A processor extracts an overdrive parameter from the lookup table corresponding to the graylevel transition between the previous frame and the current frame. Then, the processor calculates an adapted overdrive parameter that adjusts for the difference between the measured ambient temperature and the reference temperature. The resultant adapted overdrive parameter accurately achieves the desired response time without the need for multiple lookup tables calibrated at different reference temperatures, thereby reducing the need for excess memory capacity.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

Additional features will be set forth in the description which follows, and in part will be obvious from the description, or may be learned by the practice of the teachings herein. Features of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

To further clarify the features of the present invention, a more particular description of the invention will be rendered by reference to specific embodiments thereof which are illustrated in the appended drawings. It is appreciated that these drawings depict only example embodiments of the invention and are therefore not to be considered limiting of its scope. The invention will be described and explained with additional specificity and detail through the use of the accompanying drawings in which:

FIGS. 2A and 2B illustrate the manner in which temperature variations can affect the overdrive parameters that are used for obtaining the correct response time for a liquid crystal;

FIGS. 2C and 2D illustrate estimated errors in target luminance that are introduced when using a lookup table calibrated at a reference temperature to overdrive a liquid crystal operating at a different ambient temperature;

DETAILED DESCRIPTION

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Example embodiments of the present invention relate to temperature adaptive algorithms for calculating overdrive parameters to be applied to liquid crystals from an overdrive parameter lookup table. The temperature adaptive algorithm described herein is capable of calculating overdrive parameters for a wide range of temperatures, while using only a single lookup table. By using only a single lookup table, memory bandwidth is conserved, thereby reducing the memory cost of the overdrive unit used to calculate the overdrive parameters. While disclosed embodiments are described as being capable of using a single lookup table, it will be appreciated that the concepts have equal applicability in systems using multiple lookup tables as well.

As described previously, the response time of a liquid crystal may be inconsistent, and is often slower than the time period of one frame, causing the picture presented by the LCD to blur. Overdrive controllers are often employed to improve the response time of the liquid crystals in an LCD device by applying a voltage to the liquid crystals. The response time of each liquid crystal may vary depending on the graylevel produced by the liquid crystal during the preceding frame and the graylevel to be produced by the liquid crystal during the current frame. In order to compensate for the differences in response times, an overdrive controller typically extracts overdrive parameters from lookup tables which contain a plurality of overdrive parameters for the various combinations of graylevel start values and target values.

Calculating accurate overdrive parameters is complicated by the fact that the response time of liquid crystals varies based on the ambient temperature of the LCD device. Therefore, in order to ensure the clarity of the picture displayed by the LCD device, the overdrive parameters should be adjusted to compensate for the variations in temperature. FIGS. 1A-1D show the luminance response waveforms of an example LCD test panel measured at 10° C., 25° C. and 40° C. The waveforms of the current example have been processed by a 6-tap wavelet noise removal filter and normalized between 0 and 1. The three response curves of each Figure result from driving a liquid crystal at three different temperatures using the same overdrive parameter.

Figure 1A:
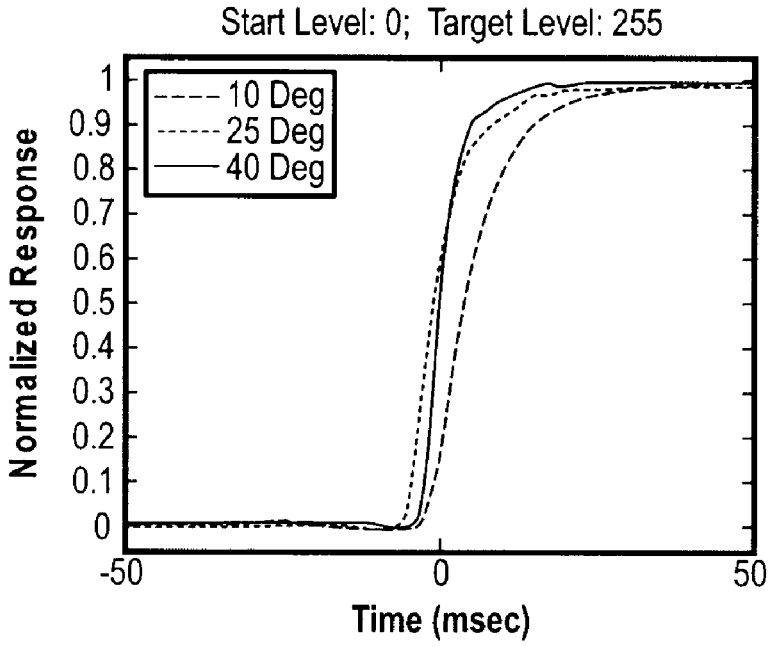
FIGS. 1A-1D illustrate the luminance response waveforms of an example LCD test panel measured at 10° C., 25° C. and 40° C.
Figure 1B:
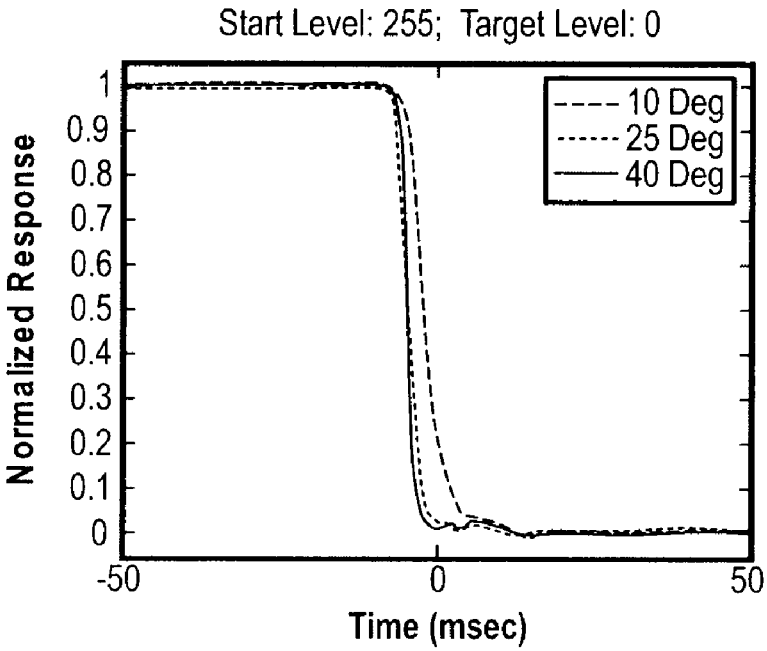

FIG. 1A illustrates the normalized black-to-white response of a liquid crystal having a graylevel start value of zero and a graylevel target value of 255, and FIG. 1B illustrates the normalized white-to-black response of a liquid crystal having a graylevel start value of 255 and a graylevel target value of zero. The graylevel start value refers to the liquid crystal graylevel of a current frame, and the graylevel target value refers to the liquid crystal graylevel of the next frame to be generated. FIGS. 1A and 1B illustrate that the changes in response behavior are relatively small between 25° C. and 40° C., whereas the transition time visibly increases at 10° C. In other words, the display becomes significantly more responsive as the temperature increases from 10° C. to 25° C., and only slightly faster as the temperature increases from 25° C. to 40° C.

Figure 1C:
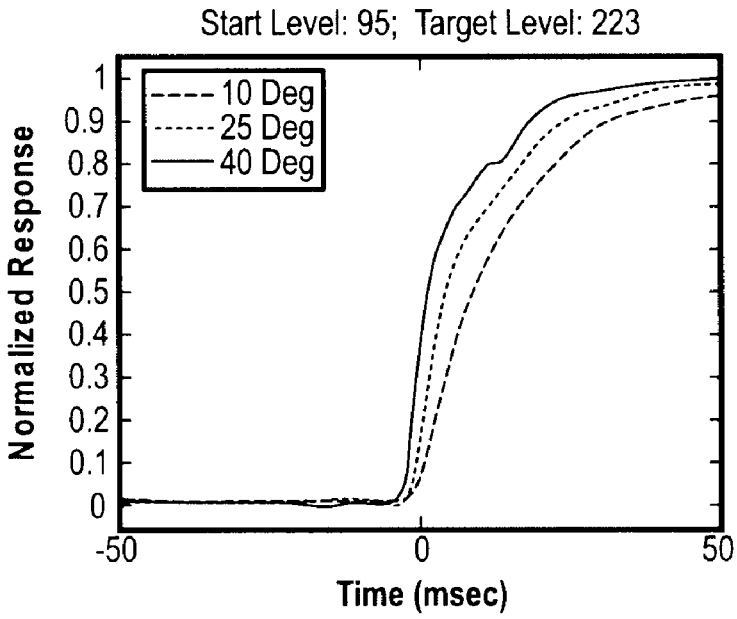
Figure 1D:
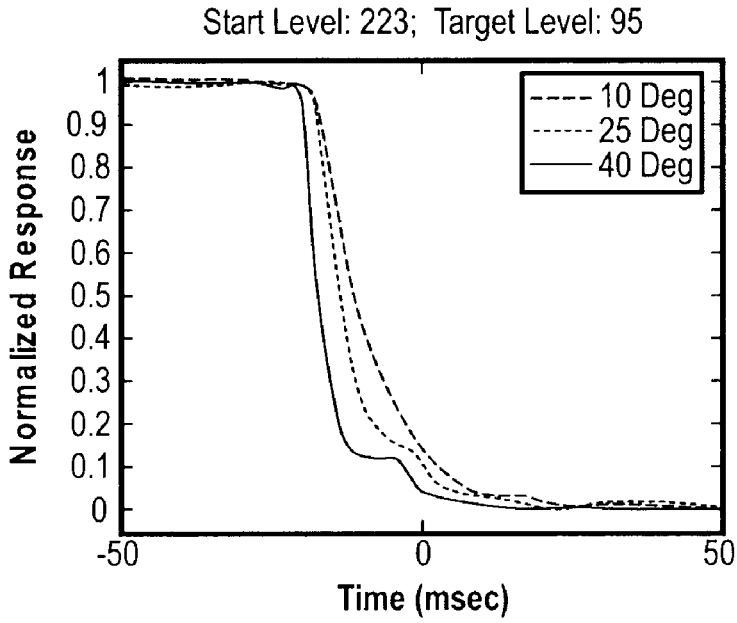

FIG. 1C illustrates the normalized gray-to-gray response of a liquid crystal having a graylevel start value of 95 and a graylevel target value of 223, and FIG. 1D illustrates the normalized gray-to-gray response of a liquid crystal having a graylevel start value of 223 and a graylevel target value of 95. Compared to FIGS. 1A and 1B, the changes in response behavior are more evenly distributed across the temperature range for gray-to-gray transitions. The response becomes progressively faster as the temperature varies from 10° C. to 25° C. and from 25° C. to 40° C.

FIGS. 2A-2D provide examples of the manner in which temperature variations can affect the overdrive parameters that are used for obtaining the correct response time for an example liquid crystal. In particular, FIGS. 2A and 2B are tables for depicting the amount of change that each calibrated overdrive parameter undergoes when the temperature changes from a first temperature to a second temperature. The FIGS. 2A and 2B include a range of graylevel start values 204 and a range of graylevel target values 202. Each combination of start levels 204 and target levels 202 is typically assigned an overdrive parameter which is calibrated to provide the proper response time for the given graylevel variation. FIGS. 2A and 2B do not depict the actual overdrive parameters themselves, but instead depict the amount of change each overdrive parameter undergoes as the ambient temperature varies. The examples illustrated in FIGS. 2A-2D employ a frame rate of 30 Hz.

Specifically, FIG. 2A shows the amount of change that the overdrive parameters 208 undergo as the ambient temperature varies from 40° C. to 10° C. For example, a liquid crystal having a graylevel start value of 95 and a graylevel target value of 223 undergoes a +5 change as the ambient temperature varies from 40° C. to 10° C.

FIG. 2B shows the amount of change that the overdrive parameters 208 undergo as the ambient temperature varies from 40° C. to 25° C. For example, a liquid crystal having a graylevel start value of 95 and a graylevel target value of 223 undergoes a +2 change as the ambient temperature varies from 40° C. to 25° C.

FIGS. 2C and 2D are tables containing estimated errors in target luminance that are introduced when using a lookup table calibrated at a reference temperature to overdrive a liquid crystal operating at a different ambient temperature. Specifically, FIG. 2C illustrates a table containing estimated graylevel transition errors introduced by using an overdrive parameter lookup table calibrated at 25° C. for a liquid crystal operating in an ambient temperature of 10° C. As illustrated in FIG. 2C, the maximum estimated error for using the lookup table calibrated for 40° C. at 10° C. is ±10 with an average error of 3.47. FIG. 2D illustrates a table containing estimated graylevel transition errors introduced by using an overdrive parameter lookup table calibrated at 40° C. for a liquid crystal operating in an ambient temperature of 10° C. As illustrated in FIG. 2D, the maximum estimated error for using the lookup table calibrated for 25° C. at 10° C. is ±7 with an average error of 2.19.

As illustrated in FIGS. 2A-2D, for a given graylevel transition, the amount of overdrive required to reach the target level generally increases as the temperature drops from 40° C. to 10° C. This observation is consistent with the response time plots illustrated in FIGS. 1A-1D. FIGS. 2A and 2B also illustrate that temperature changes have a monotonic effect on the calibrated overdrive levels in general, with larger variations observed at the graylevel transitions near the ends of the intensity spectrum.

As described previously, one conventional approach used to compensate for temperature variations is to calibrate and store multiple lookup tables for different temperature settings. However, this will inevitably increase the memory bandwidth required by the overdrive process. For end applications that operate on systems with limited resources, this approach may not be feasible. Instead of storing multiple lookup tables, disclosed embodiments of the present invention utilize a technique for estimating an overdrive parameter at an arbitrary ambient temperature from a single reference lookup table.

Figure 3:
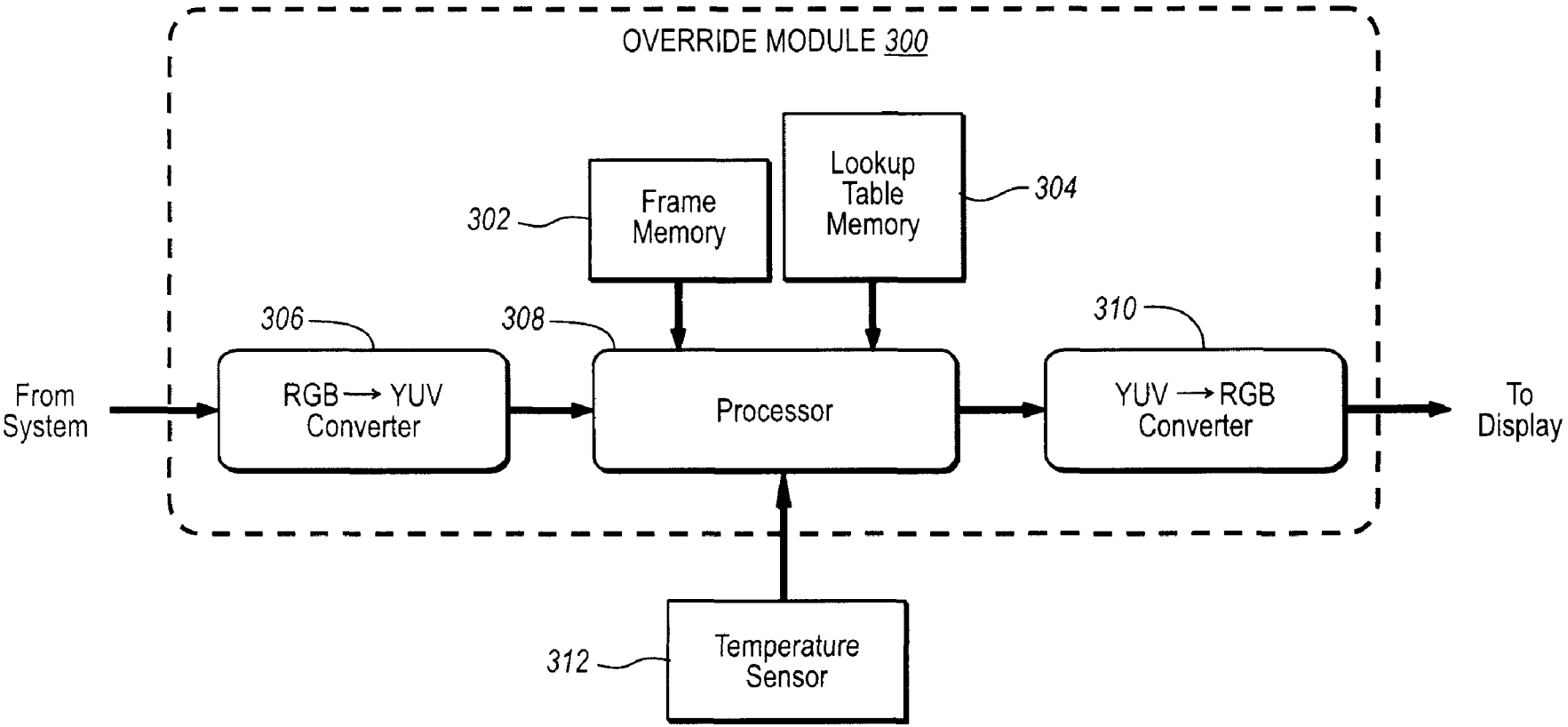
FIG. 3 illustrates a schematic block diagram of an example overdrive module used for calculating an adapted overdrive parameter.

Referring now to FIG. 3, one example of an overdrive module is illustrated and is generally identified by reference numeral 300. The illustrated overdrive module 300 determines an overdrive parameter that is customized for an ambient temperature using a single lookup table. The example overdrive module 300 includes a red-blue-green (RGB) to luminance-bandwidth-chrominance (YUV) converter 306, a processor 308, a YUV to RGB converter 310, a frame memory 302, and a lookup table memory 304. The processor 308 receives an ambient temperature reading from a temperature sensor 312.

The RGB to YUV converter 306 receives an RGB component video signal and converts the RGB component signal to YUV color space. The processor 308 receives the YUV signal and calculates the appropriate overdrive parameters so that a desired response time for the liquid crystals is achieved. In order to calculate the overdrive parameters, the processor 308 utilizes data stored in the frame memory 302 and the lookup table memory 304. Because liquid crystal response time is temperature dependent, the processor 308 also receives a temperature reading from the temperature sensor 312 in order to compensate for temperature variations. One example of a temperature adaptive overdrive technique by which the overdrive parameters are calculated will be described in detail below.

The frame memory 302 may store graylevel data for at least the previous frame and the current frame. The lookup table memory 304 stores at least one lookup table containing overdrive parameters calibrated at a reference temperature, as will be described in further detail below. Although the frame memory 302 and the lookup table memory 304 are depicted as being separated into two different memory devices, the frame data and lookup table data may also be stored in a single storage device. Similarly, the frame memory 302, the lookup table the memory 304 and the processor 308 may be integrated into a single device.

After using a temperature adaptive overdrive calculation technique to determine the appropriate overdrive parameter, the processor 308 outputs an overdriven YUV signal to the YUV to RGB converter 310, which converts the YUV signal to a RGB component signal. The RGB frame is then sent to the LCD panel for display. As will be appreciated by one of ordinary skill in the art, the RGB to YUV converter 306 and the YUV to RGB converter 310 may not be necessary in all devices. Some LCD devices employ other video formats, such as S-Video, hue-saturation-lightness (HSL), hue-saturation-value (HSV), and the like, in which case other types of converters may be employed.

The illustrated overdrive module 300 is capable of determining an overdrive parameter for a wide range of temperatures based on a single lookup table. The lookup table stored in lookup table memory 304 is calibrated at a known reference temperature. In other words, the overdrive parameters stored within the single lookup table may be used to achieve a desired response time for liquid crystal at the reference temperature. The processor 308 extracts an overdrive parameter from the lookup table memory 304 for a given graylevel start value and graylevel target value. The processor 308 then applies a temperature adaptive algorithm to the extracted overdrive parameter for calculating an adjusted overdrive parameter that accounts for the difference between the referenced temperature and the actual ambient temperature, as measured by the temperature sensor 312. One or more factors might be considered to calculate the adjusted overdrive parameter, including the graylevel start and target values, the ambient temperature, the reference temperature of the single lookup table, unique properties of the LCD display, and the like.

The processor 308 may use various techniques for optimizing the calculation of the overdrive parameter. For example, in one embodiment, the processor 308 utilizes a processor optimized implementation technique. The processor optimized implementation technique minimizes the number of operations required to complete overdrive calculation. Alternatively, the processor 308 may utilize a memory optimized implementation technique for minimizing the memory bandwidth used by the overdrive module. For example, the overdrive data in the lookup table may be interpolated in order to minimize memory use.

Example embodiments of formulas and techniques employed for determining an adjusted overdrive parameter from a single lookup table will now be described. In addition to the examples provided below, many additional techniques and formulas may be employed that also fall within the scope of the present invention for calculating an overdrive parameter from a single reference lookup table.

Figure 4:
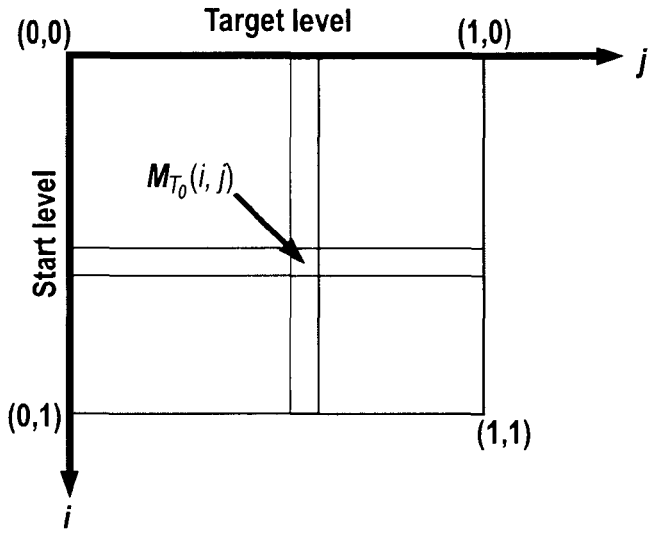
FIG. 4 illustrates one example of a normalized lookup table that may be employed during the calculation of an adapted overdrive parameter.

In one embodiment, illustrated in FIG. 4, the graylevel start values and target values of the reference lookup table are normalized between zero and one to simplify subsequent calculations. For example, a typical liquid crystal may be assigned 256 distinct graylevel values (i.e., 0-255). The normalized coordinate system, as shown in FIG. 4, may include graylevel transitions from a start graylevel $G_S$ to a target graylevel $G_T$, where i, j $\epsilon$[0,1], $G_S$=i×255 and $G_T$=j×255. The use of a normalized lookup table is not required, and the techniques and formulas described below may be altered where a normalized lookup table is not employed.

In one embodiment, the processor 308 calculates an overdrive parameter that compensates for the difference between the reference temperature $T_0$ and the ambient temperature $T_1$. The temperature adaptive overdrive algorithm may be based on a linear parametric surface model. For example, the overdrive parameter '$M_{T1}$(i,j)' may be calculated according to the following equation:

$$M_{T1}(i,j)=M_{T0}(i,j)+D(i,j)$$

'$M_{T0}$(i,j)' is the overdrive parameter extracted from the single lookup table that has been calibrated at the reference temperature $T_0$. The extracted overdrive parameter corresponds to a start graylevel 'i' and a target graylevel 'j'. 'D(i,j)' is a compensation parameter to compensate for the difference between the measured ambient temperature $T_1$ and the reference temperature $T_0$. The compensation parameter 'D(i,j)' may be calculated in any number of ways to compensate for the difference in the measure temperature.

For example, in one embodiment, the compensation parameter 'D(i,j)' is calculated by the processor 308 in accordance with the following equation:

$$D(i,j)=\alpha(T_1-T_0)$$

$\alpha$, $T_0$ and $T_1$ are measured in degrees, where $\alpha$ is a constant, $T_0$ represents the reference temperature and $T_1$ represents the measured temperature. In other words, 'D(i,j)' is an offset that accounts for the difference in temperature between the reference temperature and the measured temperature. The constant $\alpha$ can be established so as to minimize the discrepancy between the resultant overdrive parameter and an overdrive parameter that has been calibrated for the measured temperature. The constant $\alpha$ may also vary for each LCD display.

In another embodiment, the compensation parameter 'D(i, j)' further takes into account the start graylevel and the target graylevel. For example, 'D(i,j)' may be calculated by the processor 308 in accordance with the following equation:

$$D(i,j)=\alpha(T_1-T_0)f(i,j)$$

f(i,j) may include many functions that account for both the start graylevel 'i' and the target graylevel 'j' in order to obtain a more precise compensation parameter 'D(i,j)' for minimizing the error between the resultant overdrive parameter and an overdrive parameter that has been calibrated at the measured ambient temperature.

For example, in one embodiment, 'D(i,j)' is calculated by the processor 308 in accordance with the following equation:

$$D(i,j)=\begin{cases}\max[D(1,0)(1-k_1 i-k_2(1-j)),0] & \text{if } i<j\\ \min[D(0,1)(1-k_3(1-i)-k_4 j),0] & \text{if } j<i\\ 0 & \text{otherwise}\end{cases}$$

where $k_1$, $k_2$, $k_3$ and $k_4$ are constants, and where:

$$D(1,0)=\alpha_r(T_1-T_0)$$

$$D(1,0)=\alpha_f(T_1-T_0)$$

where $\alpha_r$ and $\alpha_f$ are constants measured in degrees.

Therefore, if the start graylevel value 'i' is less than the target graylevel 'j', the first equation is used, and if the target graylevel 'j' is less than the start graylevel value 'i', the second equation is used. The values of $\alpha_r$, $\alpha_f$, $k_1$, $k_2$, $k_3$ and $k_4$ can be determined by minimizing the overall error between the lookup table predicted by the $M_{T1}$(i,j)=$M_{T0}$(i,j)+D(i,j) equation and an actual table obtained using calibration at the measured temperature $T_1$. In one example, the estimated parameter values for a thin-film transistor (TFT) quarter video graphics array (QVGA) LCD test panel are $\alpha_r$=0.3, $\alpha_f$=−0.2, $k_1$=1.5, $k_2$=0.8, $k_3$=7.25 and $k_4$=−0.55.

Calculating 'D(i,j)' using the above techniques yields compensation parameters that can be used to estimate overdrive parameters for all graylevel start values and target values, and for all temperatures within a given range. The resultant compensation parameter 'D(i,j)' provides an offset to the overdrive parameter that is substantially similar to the values illustrated in FIGS. 2A and 2B. In other words, when the compensation parameters 'D(i,j)' are calculated at 10° C. using a single lookup table having a reference temperature of 40° C., the resultant compensation parameters are substantially similar to the amount of change that the overdrive parameters 206 undergo as the ambient temperature varies from 40° C. to 10° C., as illustrated in FIG. 2A.

Using the disclosed embodiments described herein to calculate overdrive parameters using a single lookup table calibrated at a reference temperature, the graylevel transition error can be reduced to a level below the "just noticeable difference" (JND) visibility threshold. JND is a commonly used measure in image coding and watermarking to define a minimum visibility threshold, below which errors in image intensity are considered imperceptible. In particular, Weber's law states that the ratio between JND and background luminance can be written as: $\Delta L=kL$, where $\Delta L$ is the difference in intensity, L is the background luminance, and k is a constant around 0.02.

Figure 5:
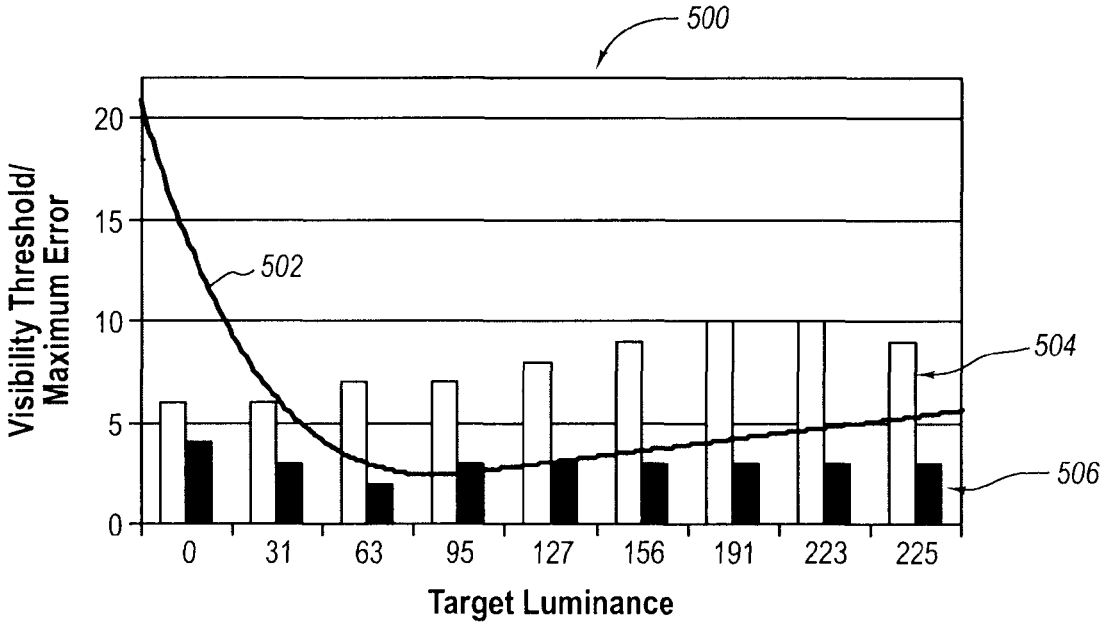
FIG. 5 illustrates a typical error visibility curve, the maximum estimated target luminance errors using the overdrive parameters extracted from a lookup table calibrated at a reference table, and the maximum estimated target luminance errors using a temperature adaptive algorithm.

The value of k has been found to deviate from Weber's law at extreme values of luminance. Instead of staying constant, k increases exponentially under dark or bright luminance conditions. A typical error visibility curve 502 is shown in FIG. 5. By maintaining the target limit errors below the error visibility curve 502, a typical user is unable to perceive the errors in image intensity.

The table 500 also depicts the maximum estimated target luminance errors 504 that result when a lookup table containing overdrive parameters calibrated at 40° C. is used for an LCD display having an ambient temperature of 10° C., without performing any type of compensation for the difference in temperature. The resultant target luminance errors 504 routinely exceed the error visibility curve 502. Also depicted in table 500 are the maximum estimated target luminance errors 506 that result when the temperature adaptive overdrive technique disclosed herein is used to calculate overdrive parameters from a single lookup table calibrated at a reference temperature. The target luminance errors 506 obtained using the temperature adaptive overdrive technique, as disclosed herein, are almost always maintained below the error visibility curve of 502. The target luminance errors have been significantly reduced after compensating for temperature changes using the single lookup table temperature adaptive overdrive technique described herein. By way of example, as the ambient temperature falls from 40° C. to 10° C., 98.6% of all graylevel transitions errors 506 remain below the visibility threshold curve 502 when using temperature adaptation, as opposed to 66.7% without temperature adaptation.

Figure 6:
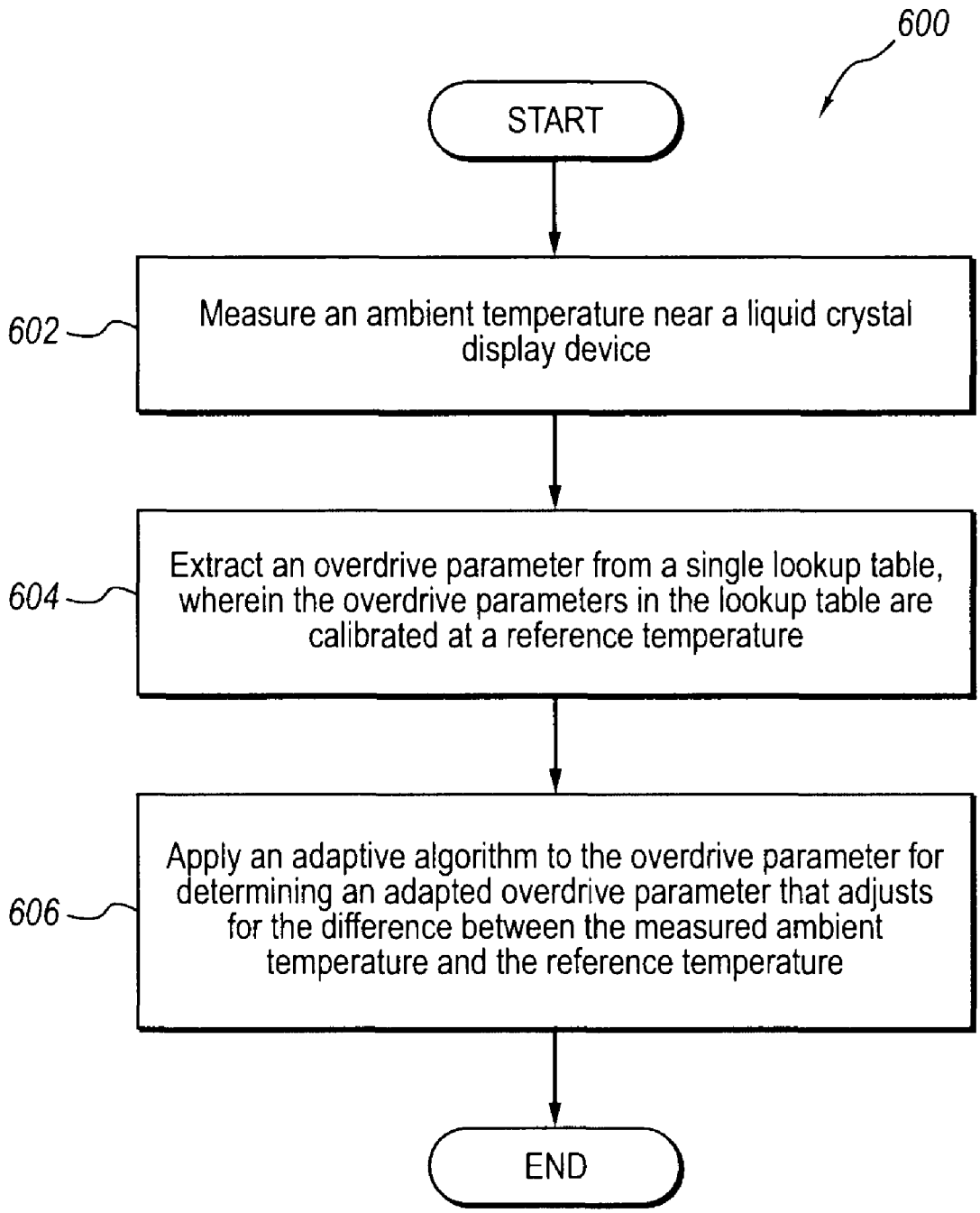
FIG. 6 illustrates a flow diagram of one example of a method for determining an overdrive parameter to compensate for temperature variations that may affect the response times of liquid crystals within an LCD display.

FIG. 6 illustrates one embodiment of an aspect of a method 600 that can be used for determining an overdrive parameter to compensate for ambient temperature variations. The method 600 may be practiced, for example, in an overdrive module 300 for determining an overdrive parameter to be applied to one or more liquid crystals within a LCD. The overdrive module may include one or more non-transitory computer-readable media having computer-executable instructions, that when executed, implement the method 600.

The method 600, beginning at step 602, measures an ambient temperature of a liquid crystal. The method 600 also includes, at step 604, extracting an overdrive parameter from a lookup table. The lookup table contains a plurality of overdrive parameters, where each overdrive parameter corresponds to a graylevel transition between a first and a second frame. For example, referring again to FIGS. 2A and 2B, the graylevel transitions refer to the various combinations of graylevel start values 204 and graylevel target values 202. Each overdrive parameter represents a level at which a liquid crystal is driven in order to achieve a desired response time for the graylevel transition. The overdrive parameters in the single lookup table are calibrated at a reference temperature. In other words, the lookup table is calibrated such that the overdrive parameters can achieve a desired response time when the ambient temperature is equal to the reference temperature.

Referring once again to FIG. 6, the method 600 applies an adaptive algorithm to the overdrive parameter extracted from the lookup table, as denoted at program step 606. The adaptive algorithm determines an adapted overdrive parameter that adjusts for the difference between the measured ambient temperature and the reference temperature. The adapted overdrive parameter can more accurately achieve the desired response time at the measured temperature than if the extracted overdrive parameter were used without being altered by the adaptive algorithm.

In one embodiment, the adapted overdrive parameter determined by the adaptive algorithm approximates an overdrive parameter calibrated at the measured ambient temperature. Therefore, the method 600 is capable of generating adapted overdrive parameters that are substantially similar to the conventional technique of using multiple lookup tables that have been calibrated at multiple different temperatures.

In one embodiment, the adaptive algorithm of the illustrated method 600 utilizes a linear parametric surface model for deriving the adaptive overdrive parameter for the measured temperature from the lookup table. In another embodiment, the adapted overdrive parameters generated by the method 600 achieve a response time that maintains over 95% of all resultant graylevel transition errors below the JND threshold, as described in reference to FIG. 5.

In one embodiment, the adaptive algorithm of the method 600 calculates an adapted overdrive parameter using the equations described above, i.e., $M_{T1}(i,j)=M_{T0}(i,j)+D(i,j)$. As described previously, the adaptive algorithm may account for the difference between the measured temperature and the reference temperature, the graylevel start value and target value, variables unique to each LCD display, and the like, and combinations thereof.

Although the method 600 may provide significant memory savings by only utilizing a single lookup table, many of the concepts of method 600 are equally applicable to systems using more than one lookup table. For example, and in one embodiment, instead of extracting the overdrive parameter from a single lookup table, the method 600 may identify multiple lookup tables that have each been calibrated at a different reference temperature, and may select one of the lookup tables from which the overdrive parameter will be extracted. For example, the method may select the lookup table that is calibrated at a temperature that closest to the measured ambient temperature. Alternatively, the method 600 may select the lookup table that is calibrated at a reference temperature that is closest to, but does not fall below the measured ambient temperature.

In the present embodiment, after selecting one of the lookup tables, the overdrive parameter can be extracted from the selected lookup table. Then, the method 600 applies the adaptive algorithm of step 606 to the extracted overdrive parameter in order to account for any differences between the reference temperature of the selected lookup table and the measured ambient temperature. Even where multiple lookup tables are used, it is highly likely that some difference will still exist between the reference temperatures of the lookup tables and the measured ambient temperature, and therefore, the adaptive algorithms described herein are still of benefit. Where multiple lookup tables are used, the reference temperatures of the multiple lookup tables may be selected such that a minimum number of lookup tables can be employed, while maintaining a high level of accuracy in the adjusted overdrive parameter calculation.

Embodiments herein may comprise a special purpose or general-purpose computer including various computer hardware implementations. Embodiments may also include non-transitory computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures and which can be accessed by a general purpose or special purpose computer.

Computer-executable instructions comprise, for example, instructions and data which cause a general purpose computer, special purpose computer, or special purpose processing device to perform a certain function or group of functions. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for driving a liquid crystal display device, the method comprising:

identifying an ambient temperature;

extracting an overdrive parameter from a lookup table containing a plurality of overdrive parameters, each overdrive parameter corresponding to a graylevel transition between a first and a second frame and representing a level at which a liquid crystal is driven in order to achieve a response time for the graylevel transition; and applying a temperature adaptive algorithm to the overdrive parameter extracted from the lookup table to determine an adapted overdrive parameter that adjusts for a difference between the identified ambient temperature and a reference temperature at which the extracted overdrive parameter is calibrated; and wherein the temperature adaptive algorithm calculates the adapted overdrive parameter '$M_{T1}(i,j)$' according to the following equation:

$$M_{T1}(i,j)=M_{T0}(i,j)+D(i,j)$$

where '$M_{T0}(i,j)$' is the overdrive parameter extracted from the lookup table for the start graylevel 'i' and the target graylevel 'j', and 'D(i,j)' is a compensation parameter to compensate for the difference between the identified ambient temperature and the reference temperature.

2. The method as recited in claim 1, wherein the temperature adaptive algorithm utilizes a linear parametric surface model.

3. The method as recited in claim 1, wherein the lookup table is comprised of a mapping of a plurality of start graylevels to a plurality of target graylevels, wherein each overdrive parameter corresponds to a graylevel variation between one of the start graylevels and one of the target graylevels, wherein the start graylevels and the target graylevels are normalized between zero (0) and one (1).

4. The method as recited in claim 1, wherein the temperature adaptive algorithm further calculates 'D(i,j)' according to the following equation:

$$D(i,j)=\alpha(T_1-T_0)f(i,j)$$

where $\alpha$, $T_0$ and $T_1$ are measured in degrees, and where $\alpha$ is a constant, $T_0$ represents the reference temperature and $T_1$, represents the identified ambient temperature, and where f(i,j) is a function of the start graylevel 'i' and the target graylevel 'j'.

5. The method as recited in claim 4, wherein the calculation of 'D(i,j)' further comprises:

$$D(i,j)=\begin{cases}\max[D(1,0)(1-k_1 i-k_2(1-j)),0] & \text{if } i<j\\ \min[D(0,1)(1-k_3(1-i)-k_4 j),0] & \text{if } j<i\\ 0 & \text{otherwise}\end{cases}$$

where $k_1$, $k_2$, $k_3$ and $k_4$, are constants, and where:

$$D(1,0)=\alpha_r(T_1-T_0)$$

$$D(0,1)=\alpha_f(T_1-T_0)$$

where $\alpha_r$ and $\alpha_f$ are constants measured in degrees.

6. The method as recited in claim 5, wherein $k_1$, $k_2$, $k_3$ and $k_4$, $\alpha_r$ and $\alpha_f$ are customizable for each unique liquid crystal display device, and are determined by minimizing the error between the temperature adaptive algorithm and actual lookup tables obtained using calibration at various temperatures.

7. A system for compensating for temperature variations within a liquid crystal display device, comprising:

a temperature sensor configured to measure an ambient temperature;

a memory configured to store a lookup table containing a plurality of overdrive parameters, each overdrive parameter corresponding to a graylevel transition between a previous frame and a current frame and representing a level at which a liquid crystal is driven in order to achieve a response time for the graylevel transition, wherein the overdrive parameters in the lookup table are calibrated at a reference temperature; and a processor configured to extract an overdrive parameter from the lookup table corresponding to the graylevel transition between the previous frame and the current frame, and further configured to calculate an adapted overdrive parameter that adjusts for the difference between the measured ambient temperature and the reference temperature at which the extracted overdrive parameter is calibrated; and wherein the processor is further configured to calculate the adapted overdrive parameter '$M_{T1}(i,j)$' according to the following equation:

$$M_{T1}(i,j)=M_{T0}(i,j)+D(i,j)$$

where '$M_{T0}(i,j)$' is the overdrive parameter extracted from the lookup table for the start graylevel 'i' and the target graylevel 'j', and 'D(i,j)' is a compensation parameter to compensate for the difference between the measured ambient temperature and the reference temperature.

8. The system as recited in claim 7, further comprising:

a first conversion module configured to convert a video signal from red-blue-green (RGB) to luminance-bandwidth-chrominance (YUV) color space, the first conversion module having an output coupled to an input of the processor; and a second conversion module configured to convert the video signal from YUV to RGB color space, the second conversion module having an input coupled to an output of the processor.

9. The system as recited in claim 8, further comprising:

a liquid crystal display configured to display the output of the second conversion module.

10. The system as recited in claim 7, wherein the processor interpolates the overdrive parameters in the lookup table.

11. The system as recited in claim 7, wherein the lookup table is comprised of a mapping of a plurality of start graylevels to a plurality of target graylevels, wherein each overdrive parameter corresponds to a graylevel variation between one of the start graylevels and one of the target graylevels, wherein the start graylevels and the target graylevels are normalized between zero (0) and one (1).

12. The system as recited in claim 7, wherein the processor is further configured to calculate 'D(i,j)' according to the following equation:

$$D(i,j)=\alpha(T_1-T_0)f(i,j)$$

where a , $\alpha$, $T_0$ and $T_1$ are measured in degrees, and where a is a constant, $T_0$ represents the reference temperature and $T_1$ represents the measured temperature, and where f(i,j) is a function of the start graylevel 'i' and the target graylevel 'j'.

13. The system as recited in claim 12 wherein the calculation of 'D(i,j)' further comprises:

$$D(i,j)=\begin{cases}\max[D(1,0)(1-k_1 i-k_2(1-j)),0] & \text{if } i<j\\ \min[D(0,1)(1-k_3(1-i)-k_4 j),0] & \text{if } j<i\\ 0 & \text{otherwise}\end{cases}$$

where $k_1$, $k_2$, $k_3$ and $k_4$, are constants, and where:

$$D(1,0)=\alpha_r(T_1-T_0)$$

$$D(0,1)=\alpha_f(T_1-T_0)$$

where $\alpha_r$ and $\alpha_f$ are constants measured in degrees.

14. In an overdrive module for determining an overdrive parameter to be applied to one or more liquid crystals within a liquid crystal display, a computer program product configured to implement a method of determining the overdrive parameter to compensate for temperature variations, the computer program product comprising one or more non-transitory computer readable media having stored thereon computer executable instructions that, when executed by a processor, cause the overdrive module to perform the following:

obtain an ambient temperature;

extract an overdrive parameter from a lookup table containing a plurality of overdrive parameters, each overdrive parameter corresponding to a graylevel transition between a first and a second frame and representing a level at which a liquid crystal is driven in order to achieve a response time for the graylevel transition, wherein the overdrive parameters in the lookup table are calibrated at a reference temperature; and apply a temperature adaptive algorithm to the overdrive parameter extracted from the lookup table for determining an adapted overdrive parameter, the temperature adaptive algorithm being a function of at least the ambient temperature, the reference temperature, a start graylevel and a target graylevel; and wherein the temperature adaptive algorithm calculates the adapted overdrive parameter '$M_{T1}(i,j)$' according to the following equation:

$$M_{T1}(i,j)=M_{T0}(i,j)+D(i,j)$$

where '$M_{T0}(i,j)$' is the overdrive parameter extracted from the lookup table for the start graylevel 'i' and the target graylevel 'j', and 'D(i,j)' is a compensation parameter to compensate for the difference between the ambient temperature and the reference temperature.

15. The computer program product comprising one or more non-transitory computer readable media as recited in claim 14, further comprising instructions, that when executed:

identify a plurality of lookup tables, each calibrated at a different reference temperature, and each lookup table having a plurality of overdrive parameters; and select a lookup table that is calibrated at a temperature that relates to the ambient temperature.

16. The computer program product comprising one or more non-transitory computer readable media as recited in claim 14, wherein the temperature adaptive algorithm further calculates 'D(i,j)' according to the following equation:

$$D(i,j)=\alpha(T_1-T_0)f(i,j)$$

where $\alpha$, $T_0$ and $T_1$ are measured in degrees, and where $\alpha$is a constant, $T_0$ represents the reference temperature and $T_1$, represents the ambient temperature, and where f (i,j) is a function of the start graylevel 'i' and the target graylevel 'j'.

17. The computer program product comprising one or more non-transitory computer readable media as recited in claim 16 wherein the calculation of '(i,j)' further comprises:

$$D(i,j)=\begin{cases}\max[D(1,0)(1-k_1 i-k_2(1-j)),0] & \text{if } i<j\\ \min[D(0,1)(1-k_3(1-i)-k_4 j),0] & \text{if } j<i\\ 0 & \text{otherwise}\end{cases}$$

where $k_1$, $k_2$, $k_3$ and $k_4$, are constants, and where:

$$D(1,0)=\alpha_r(T_1-T_0)$$

$$D(0,1)=\alpha_f(T_1-T_0)$$

where $\alpha_r$ and $\alpha_f$ are constants measured in degrees.

* * * * *

UNITED STATES PATENT AND TRADEMARK OFFICE

CERTIFICATE OF CORRECTION

PATENT NO. : 7,804,470 B2
APPLICATION NO. : 11/690632
DATED : September 28, 2010
INVENTOR(S) : Eunice Poon It is certified that error appears in the above-identified patent and that said Letters Patent is hereby corrected as shown below:

Column 11,
Line 47, please change "and $T_1$, represents" to --and $T_1$ represents--

Line 59, please change "where $k_1$, $k_2$, $k_3$ and $k_4$, are constants," to --where $k_1$, $k_2$, $k_3$ and $k_4$ are constants,--

Line 65, please change "wherein $k_1$, $k_2$, $k_3$ and $k_4$, $\alpha_r$ and $\alpha_f$ are customizable" to --wherein $k_1$, $k_2$, $k_3$, $k_4$, $\alpha_r$ and $\alpha_f$ are customizable--

Column 12,
Line 61, please change "where a, $\alpha$, $T_0$ and $T_1$" to --where $\alpha$, $T_0$ and $T_1$--

Line 62, please change "a is a constant" to --$\alpha$ is a constant--

Column 13,
Line 8, please change "where $k_1$, $k_2$, $k_3$ and $k_4$, are constants" to --where $k_1$, $k_2$, $k_3$ and $k_4$ are constants--

Column 14,
Line 21, please change "where $\alpha$is" to --where $\alpha$ is--

Line 23, please change "$T_1$, represents" to --$T_1$ represents--

Line 28, please change "claim 16 wherein" to --claim 16, wherein--

Line 28, please change "of '(i,j)' further" to --of 'D(i,j)' further--

Line 36, please change "where $k_1$, $k_2$, $k_3$ and $k_4$, are constants" to --where $k_1$, $k_2$, $k_3$ and $k_4$ are constants--

Signed and Sealed this

Twenty-first Day of December, 2010

David J. Kappos

David J. Kappos
*Director of the United States Patent and Trademark Office*